United States Patent [19]

Gölzer

[11] Patent Number: 4,730,872

[45] Date of Patent: Mar. 15, 1988

[54] BENCH WITH V-SHAPED SLATS

[76] Inventor: Siegbert Gölzer, Keplerstrasse 3, 660 Saarbruecken, Fed. Rep. of Germany

[21] Appl. No.: 888,005

[22] Filed: Jul. 22, 1986

[30] Foreign Application Priority Data

Jul. 22, 1985 [DE] Fed. Rep. of Germany ..... 3526106

[51] Int. Cl.[4] ..... A47C 15/00

[52] U.S. Cl. ..... 297/232; 297/284; 297/452

[58] Field of Search ..... 297/232, 284, 252, 243, 297/452, 460, 444; 248/120

[56] References Cited

U.S. PATENT DOCUMENTS

| | | | |
|---|---|---|---|
| 2,000,624 | 5/1935 | Traves | 297/284 X |
| 3,464,753 | 9/1969 | Ryn | 297/232 |
| 3,565,482 | 2/1971 | Blodee | 297/284 |
| 3,877,750 | 4/1975 | Scholpp | 297/284 |
| 3,893,729 | 7/1975 | Sherman et al. | 297/232 X |
| 3,990,742 | 11/1976 | Glass et al. | 297/284 X |
| 4,347,840 | 9/1982 | Adams | 297/284 X |
| 4,382,628 | 5/1983 | Palmgron | 297/232 |
| 4,426,114 | 1/1984 | Kehl et al. | 297/232 |
| 4,489,978 | 12/1984 | Brennan | 297/232 |
| 4,585,272 | 4/1986 | Ballarini | 297/284 |

FOREIGN PATENT DOCUMENTS

| | | | |
|---|---|---|---|
| 2360441 | 3/1978 | France | 297/232 |
| 2022403 | 12/1979 | United Kingdom | 297/232 |

*Primary Examiner*—Kenneth J. Dorner
*Assistant Examiner*—José V. Chen

[57] ABSTRACT

Sitting bench for public facilities, such as parks, street, waiting rooms and lounges on subways, airports or the like, having two or more interconnected stands exhibiting the approximate configuration of seats, equipped with floor or wall fastening elements and serving to support the seat slats, which together form the seating surface. The seat slats are triangular in cross section. The stands are equipped with corresponding acutely angled, V-shaped supports or receiving grooves to which the slats are fastened by screws penetrating the supports in the area of their points. A bead is provided on the outer edge of the stands and the floor or wall fastening elements are half-shells divided in their longitudinal center plane and equipped with a clamping groove to grip the bead.

15 Claims, 6 Drawing Figures

BENCH WITH V-SHAPED SLATS

BACKGROUND OF THE INVENTION

1. Field of the Invention

The invention relates to a sitting bench for public facilities, such as parks, streets, waiting rooms and lounges in subway stations, airports or the like, comprising two or more interconnected stands having the approximate configuration of a seat and equipped with floor or wall fastening elements and serving as supports for a plurality of seat slats forming together a seating surface.

2. Description of the Related Technology

In known sitting benches the bottom or wall fastening elements are joined in a single piece with the parts of the stand. They are normally metallic and cast or welded on. The stand elements are equipped with flange-like projecting straight line flat supports. Rectangular slats which form a seating surface are fastened to the supports by screw connectors. Known sitting benches have a series of disadvantages, including high manufacturing costs, and limited applications. For example, known benches are suitable only for floor erection or wall suspension, therefore different models must be manufactured and maintained in inventory for the different modes of installation. A further disadvantage is the considerable inherent liability of the prior benches. Even a slight loosening of floor or wall screw joints reduces stability to an unsafe level. Transverse bracing must be provided between the parts of the stands to maintain safety requirements thereby further increasing production and inventory costs. To avoid these disadvantages the bench supports comprising two stands are braced together and wall parts are made in a single piece, thereby reducing the number of possible applications, limiting the fixed length of the bench, and consequently restricting the number of seats. Transportation also becomes appreciably more difficult.

SUMMARY OF THE INVENTION

An object of the invention is to provide a sitting bench for public facilities which would allow multiple applications, while being simple to produce and capable of reducing inventory costs and which would assure a high degree of seating comfort, together with great stability. According to the invention the seating slats are triangular in cross section and the stands are correspondingly equipped with acutely angled V-shaped supports. The slats are fastened to the supports by screws penetrating the supports in the pointed area.

The invention is directed toward a sitting bench particularly suited for public facilities enabling multiple applications while being simple to produce and capable of reducing inventory costs by the use of acutely angled V-shaped supports in combination with essentially triangular seating flats fastened by screws penetrating deeply into the V-shaped supports. The assembly is strengthened to the extent that further transverse bracing is unnecessary and extension of the slats and thus bench length is increased far beyond the measure of previous models. Bench stability is enhanced to where it is possible to erect the bench freely without the use of further floor or wall fastenings and without any loss of stability or safety by the fixed clamping of the triangular slats into the V-shaped supports. Inventory maintenance is simplified because it is merely necessary to inventory identically shaped stand elements and slats of the different desired lengths.

To further simplify inventories and to increase the number of possible applications the stands are advantageously provided with gripping surfaces at their outer edges and the floor and wall fastening elements are divided into two half-shell elements along a longitudinal center plane, with each of the elements exhibiting a clamping groove gripping the gripping surface. The gripping surface appropriately exhibits a constant configuration (straight line or uniformly bent) in several segments of its length that is adapted to the shape of the clamping groove. In this manner it is possible to erect sitting benches of any length, selectively fastened to the floor or to a wall, so that the result of all of the requirements encountered in public places or buildings may be satisfied merely with the use of three or a maximum of four elements, i.e., stands, one or two models of half-shell fastening elements, and triangular slats. All of these elements are flat parts requiring little space which can be assembled on site, so that inventory costs are further reduced and transportation is simplified.

BRIEF DESCRIPTION OF THE DRAWINGS

The invention is explained below by an example with reference to the drawings wherein.

DETAILED DESCRIPTION OF THE PREFERRED EMBODIMENT

Figure 1:
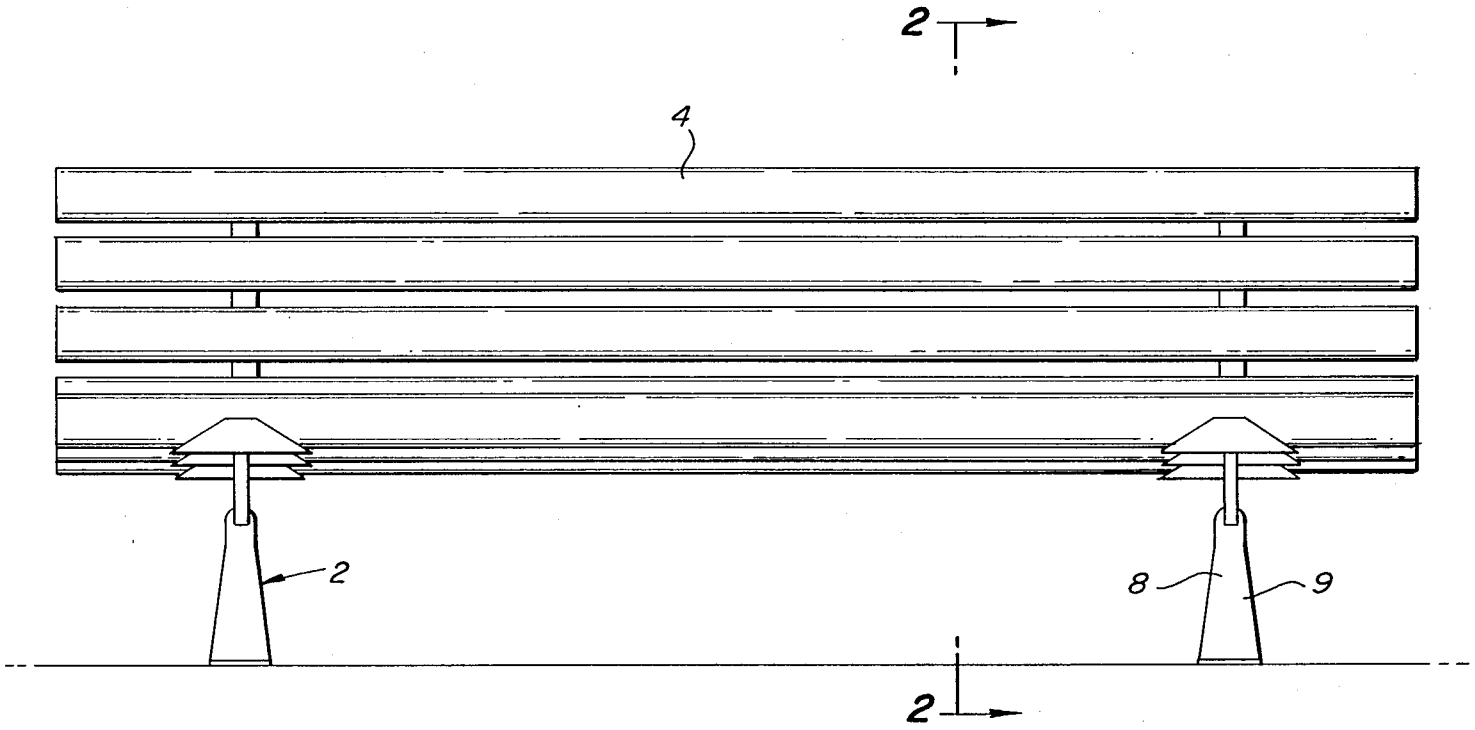
FIG. 1 is a view of a sitting bench according to the invention.
Figure 2:
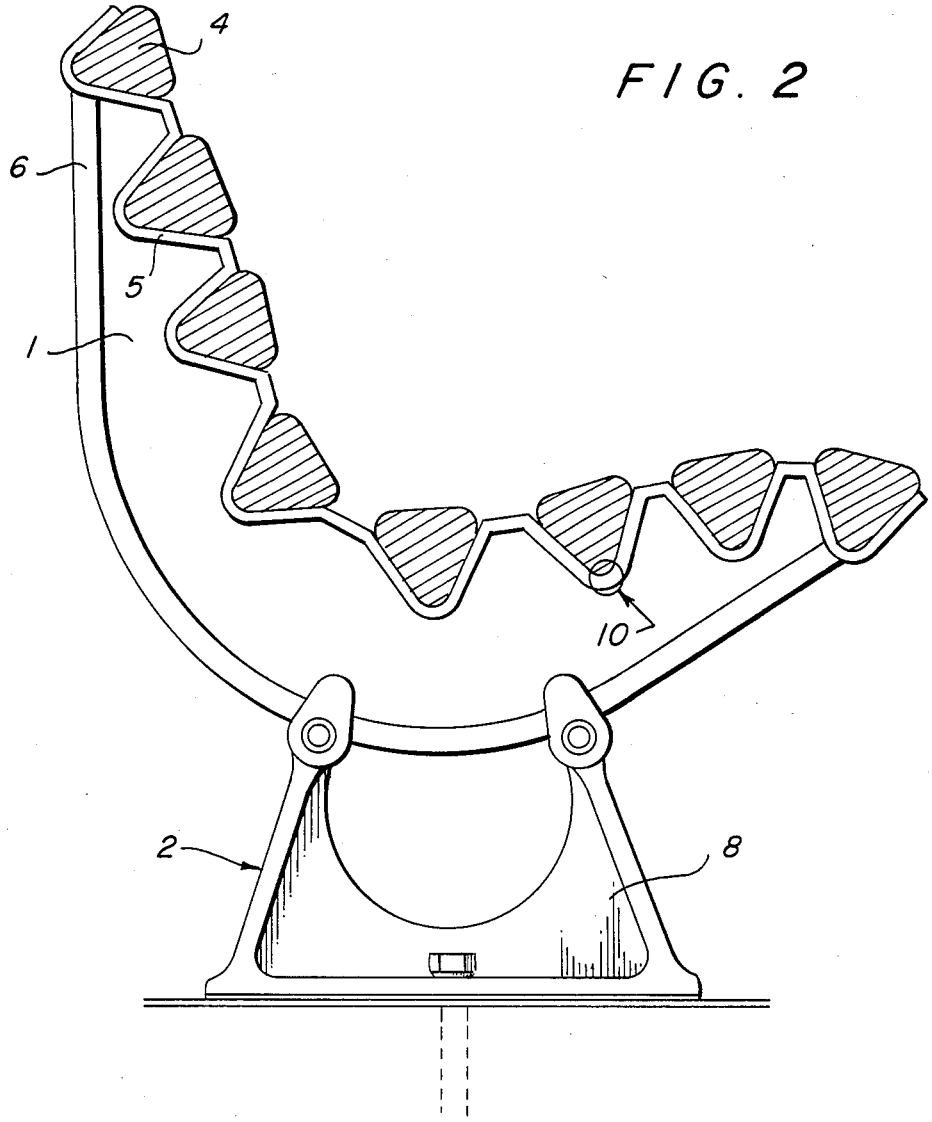
FIG. 2 is a section through the sitting bench of FIG. 1.
Figure 3:
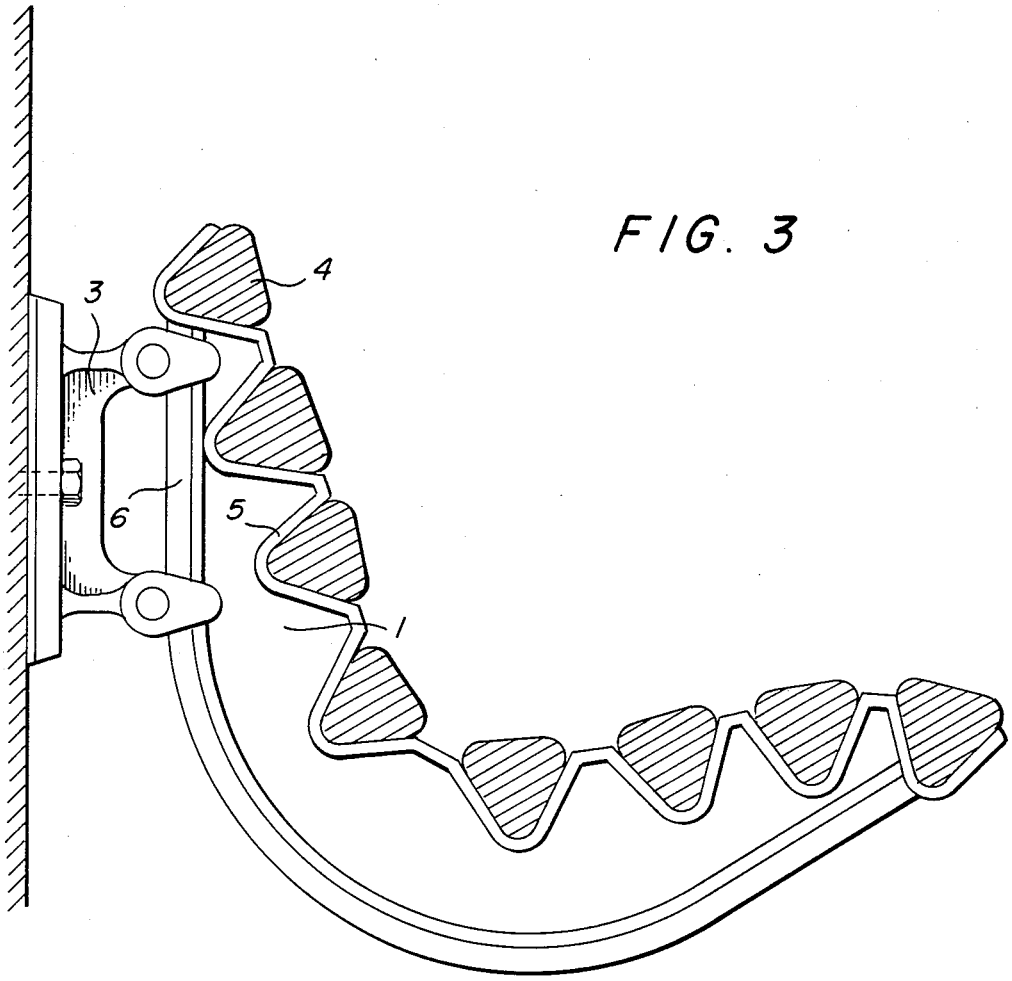
FIG. 3 is a section through the sitting bench shown in FIG. 1 fastened to a wall.
Figure 4:
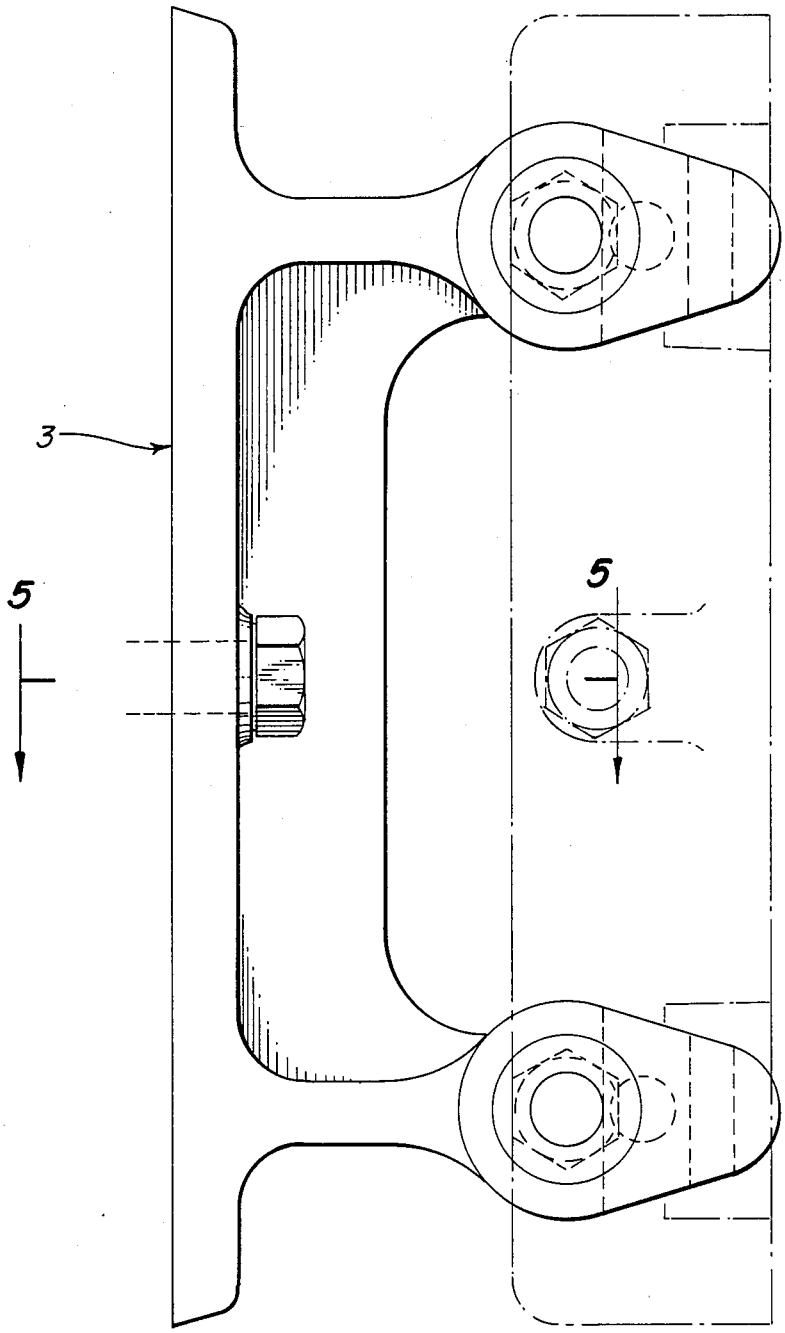
FIG. 4 is an enlarged view of the wall fastening according to FIG. 3.
Figure 5:
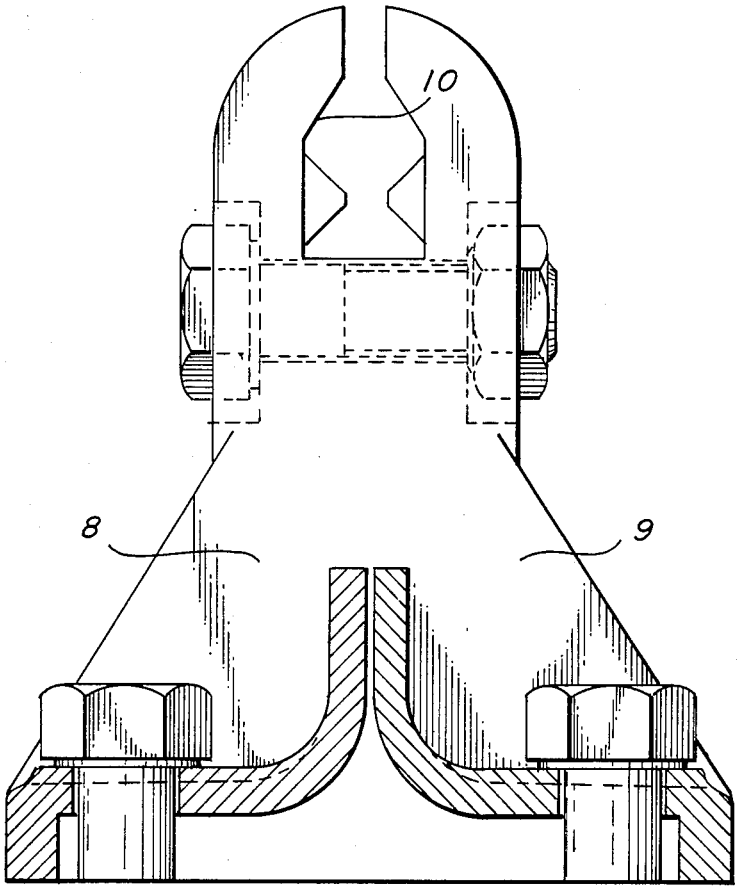
FIG. 5 is a section through FIG. 4.
Figure 6:
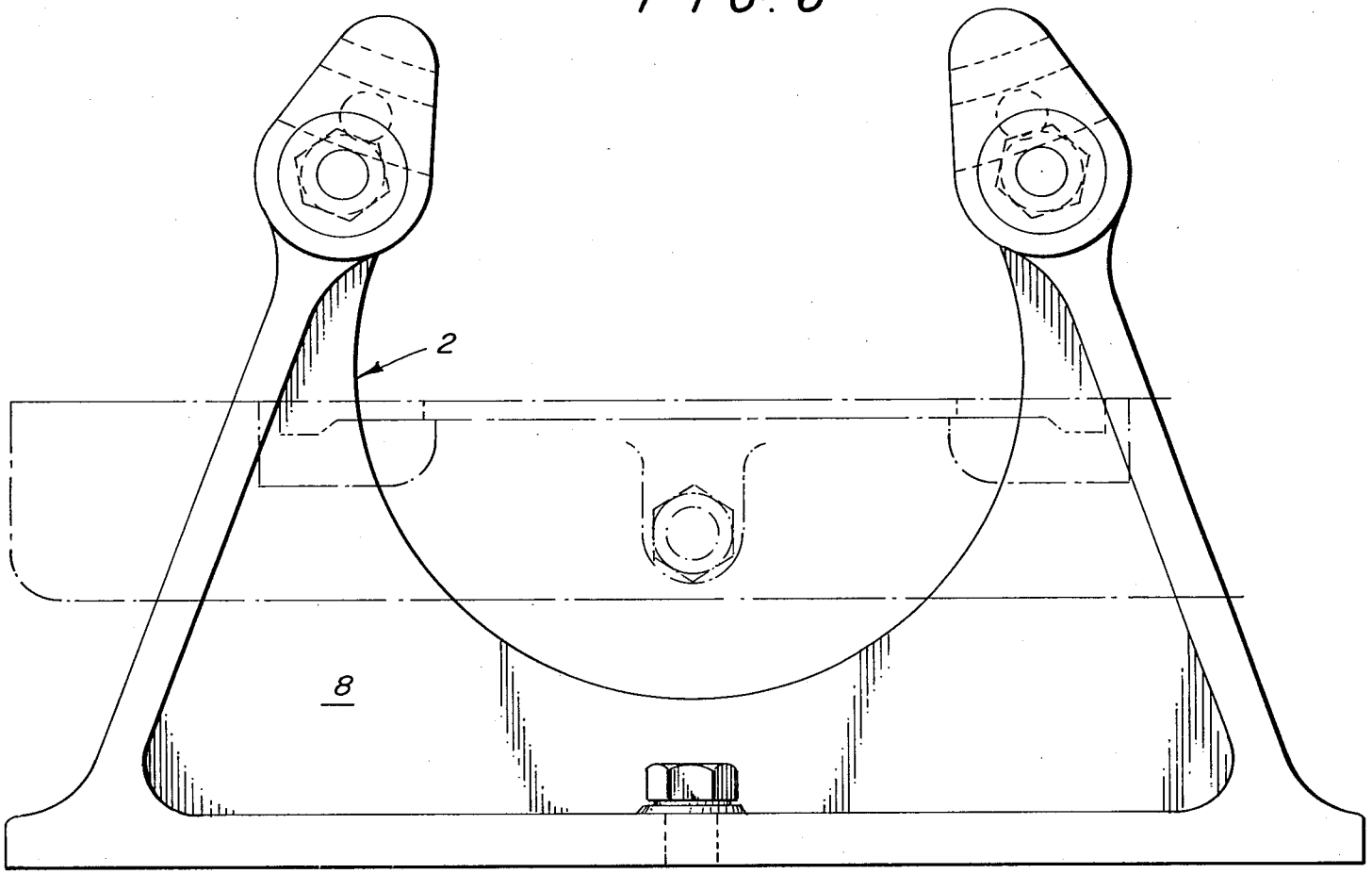
FIG. 6 is a further embodiment of the fastening particularly for floor mounting.

The sitting bench, shown in the drawings, for public facilities, such as parks, streets, waiting rooms and lounges of subways, airports or the like, comprises two or more stands 1 having the approximate shape of a seat and equipped with floor fastening elements 2 as in FIG. 2 or with wall fastening elements 3 as in FIG. 3. The stands 1 serve as supports for a plurality of seating slats 4, which together form a seating surface. The seating slats 4 are triangular in cross section, while the stands 1 are provided with acutely angular V-shaped supports 5 of a corresponding configuration. The slats 4 may be fastened by slat-securing means 10' for fastening the slats 4 to the stands 1 such as by screws penetrating the supports 5. The screws may advantageously penetrate the support 5 at the points or vertex, not adjacent to the support surface of the slats.

The stands 1 are equipped with gripping surfaces 6 at their outer edges. The floor and wall fastening elements 2, 3 are exemplary mounting means for fastening the stands to a mounting surface. They may be made up of half-shell elements 8, 9 divided in their longitudinal center plane and provided with a clamping groove 10 to grip the gripping surface 6. The floor and wall fastening elements may have different configurations as shown in the drawings and the clamping grooves may differ to adapt to the type of fastening. The gripping surface may also have different configurations in several segments of its length. The configuration may advantageously be constant (straight line or uniformly bent) to conform to the shape of the clamping groove, so that use of the same fastening elements for both wall suspension or floor fastening is possible. This further simplifies manufacturing and inventory maintenance. The half-shell elements have bore holes allowing passage of the screws or bolts as close to the clamping grooves as possible. The halves may be tightened after the gripping parts are arranged to clamp the bead of the stands.

What is claimed is:

1. A sitting bench comprising:

two stands having an angled configuration and a plurality of V-shaped support surfaces;

a plurality of seat slats having a triangular cross-section and arranged to have an apex lie within the V-shaped surface in said V-shaped support surfaces, to extend between said stands and to define a seating surface;

slat-securing means for fastening said slats to said stands; and mounting means for fastening said stands to a mounting surface.

2. A sitting bench according to claim 1, wherein each of said stands further comprises a gripping surface on an outer edge and each of said mounting means comprising a first and second half-shell element, each element having a clamping groove for gripping said gripping surface.

3. A sitting bench according to claim 2, wherein said gripping surface has a constant configuration and matches that of said clamping groove.

4. A sitting bench according to claim 3, further comprising tightening means for tightening said first half-shell and said second half-shell against said gripping surface.

5. A sitting bench according to claim 2, further comprising securing means for tightening said first half-shell and said second half-shell against said gripping surface.

6. A sitting bench comprising:

two stands having an approximate configuration of a seat and a plurality of V-shaped support surfaces;

a plurality of seat slats of a triangular cross-section and arranged to have an apex lie within the V-shaped surface in said V-shaped support surfaces, to extend between said stands, and to define a seating surface;

slat-securing means for fastening said slats to said stands;

mounting means for fastening said stands to a vertical mounting surface.

7. A sitting bench according to claim 6, wherein each of said stands further comprises a gripping surface on an outer edge and each of said mounting means comprises a first and a second half-shell element, each element exhibiting a clamping groove for gripping said gripping surface.

8. A sitting bench according to claim 7, wherein said gripping surface has a constant configuration and matches that of said clamping groove.

9. A sitting bench according to claim 8, further comprising tightening means for tightening said first half-shell and said second half-shell against said gripping surface.

10. A sitting bench according to claim 7, further comprising means for tightening said first half-shell and said second half-shell against said gripping surface.

11. A sitting bench comprising:

two stands having an and a plurality of V-shaped support surfaces;

a plurality of seat slats having a triangular cross-section and arranged to have an apex lie within the V-shaped surface in said V-shaped support surfaces, to extend between said stands, and to define a seating surface;

slat-securing means for fastening said slats to said stands; and mounting means for fastening said stands to a horizontal mounting surface.

12. A sitting bench according to claim 11, wherein each of said stands further comprises a gripping surface on an outer edge and each of said mounting means comprises a first and a second half-shell element, each element having a clamping groove for gripping said gripping surface.

13. A sitting bench according to claim 12, wherein said gripping surface has a constant configuration and matches that of said clamping groove.

14. A sitting bench according to claim 13, further comprising tightening means for tightening said first half-shell and said second half-shell against said gripping surface.

15. A sitting bench according to claim 12, further comprising tightening means for tightening said first half-shell and said second half-shell against said gripping surface.

* * * * *